US005114313A

United States Patent [19]

Vorus

[11] Patent Number: 5,114,313

[45] Date of Patent: May 19, 1992

[54] BASE VENTED SUBCAVITATING MARINE PROPELLER

[75] Inventor: William S. Vorus, Gregory, Mich.

[73] Assignee: 501 Michigan Wheel Corp., Grand Rapids, Mich.

[21] Appl. No.: 506,944

[22] Filed: Apr. 10, 1990

[51] Int. Cl.[5] ..... B63H 1/28

[52] U.S. Cl. ..... 416/93 A; 416/243

[58] Field of Search ..... 416/93 A, 223 R, 234, 416/242, 243

[56] References Cited

U.S. PATENT DOCUMENTS

| | | | |
|---|---|---|---|
| 3,109,495 | 11/1963 | Lang | 416/93 A |
| 3,306,246 | 2/1967 | Reder | 416/243 |
| 4,417,852 | 11/1983 | Costabile et al. | 416/93 A |
| 4,789,306 | 12/1988 | Vorus et al. | 416/234 |
| 4,790,724 | 12/1988 | Bousquet et al. | 416/243 |
| 4,875,829 | 10/1989 | Van der Woude | 416/93 A |

FOREIGN PATENT DOCUMENTS

| | | | |
|---|---|---|---|
| 124583 | 4/1949 | Sweden | 416/93 A |

*Primary Examiner*—Edward K. Look
*Assistant Examiner*—James A. Larson
*Attorney, Agent, or Firm*—Harness, Dickey & Pierce

[57] ABSTRACT

A propeller assembly for mounting on the drive shaft of a motorized water vehicle. The propeller consists of a central hub having a hollow body of circular cross-sectional shape through which exhaust gas from the motor can flow. Integrally formed with the hub are a number of arcuate blades. Each blade has a generally fish-shaped axial cross-sectional shape. In particular, from the leading edge of the blade, the cross-sectional shape increases in thickness until reaching a local maximum at a point near the midchord of the blade and thereafter decreases in thickness until reaching a local minimum. The blade thereafter again increases in thickness along concave surfaces until terminating in a concave trailing edge. The trailing edge of the blades are in communication with the exhaust gas flowing through the hub.

6 Claims, 2 Drawing Sheets

BASE VENTED SUBCAVITATING MARINE PROPELLER

BACKGROUND AND SUMMARY OF THE INVENTION

The invention relates to a propeller for commercial, pleasure and racing boats, and more particularly to a base vented propeller for boats driven by large outboard or stern-drive motors.

With the popularity of boating increasing, the number of damaged propellers needing replacement is also increasing. While many propellers are replaced because of structural damages, numerous others are replaced in an attempt to upgrade the drive system of the boat. These replacement propellers are commonly constructed of cast aluminum or stainless steel.

It is generally believed that an injection molded plastic propeller can be produced cheaper than the standard aluminum replacement propeller. While several plastic propellers are presently on the market, current technology provides limited propeller performance in engine power ranges exceeding 20 horsepower.

In the construction of a plastic propeller, difficulty is generally encountered as a result of an incompatibility between the structural requirements and the hydrodynamic performance requirements of the propeller blades. More specifically, in producing a plastic propeller having adequate strength and stiffness, blade thickness becomes hydrodynamically excessive. At the expense of thrust production, and therefore boat speed, engine power is lost overcoming the high drag induced by the blade's thickness.

It is an object of the present invention to provide a inexpensive propeller incorporating increased thickness while maintaining drag at competitive levels.

It is another object of the invention to provide a high performance, low drag, subcavitating propeller assembly.

The U.S. Patent Application entitled "BASE VENTED SUBCAVITATING HYDROFOIL SECTION", filed Apr. 4, 1990, Ser. No. 509,952, Notice of Allowance dated Apr. 30, 1991, U.S. Pat. No. 5,046,444 commonly assigned to by the Applicant of the present invention, discloses a hydrofoil section that is capable of subcavitating at high speeds while maintaining hydrofoil section drag at acceptable levels. The above application is herein incorporated by reference.

In the present invention, an increased blade thickness is incorporated into each propeller. However, even with the thickness increase, the total section drag of each blade is held at low levels through base venting, as disclosed in the above mentioned application. Each propeller blade has a forward fin portion and a rearwardly flared base or post portion. The fin and post are integrally formed with each other and also with a propeller hub of the standard "flow through" exhaust gas variety. Cavitation is prevented by drawing exhaust gas, exiting the hub, along the rear surface, or trailing edge, of the base and venting a low pressure region developing downstream of each blade. The base portions of each blade are locally flared so as to build high pressure fences along the trailing edge. The high pressure fences prevent ventilation gas (exhaust gas) from flooding into the low pressure region developing on the suction surfaces of the blades and causing back ventilation. Additionally, the flares of the base portions reduce fluid flow velocities over the blade surfaces and in this manner the development of cavitation is delayed. Thus, each blade of the propeller exhibits a drag reduction through base ventilation.

In the present invention, two embodiments of the base vented propeller are disclosed. The first embodiment is constructed of stainless steel and the second of plastic. The blades of the base vented steel propeller have a midchord thickness generally comparable to propellers now present in the industry. However, the increased flaring of the blades and venting of the bases, along with the low drag associated with the subsequent postponement of cavitation, permit the subcavitating performance range of the base vented steel propeller to be extended beyond the abilities of conventional propellers.

By virtue of the thickened base portion, both embodiments of the present invention exhibit an increase in strength relative to propeller blades of the same length and midchord thickness. However, being constructed of plastic, the second embodiment has need for a further strength increase. This is accomplished by increasing the midchord thickness of each blade. Even though the additional midchord thickness also increases the pressure drag of the blade, the strength and subcavitating benefits of base venting allow the plastic propeller of the present invention to exhibit performance specifications corresponding to the aluminum replacement propellers presently on the market. While the performance is comparable, the base vented plastic propeller has substantial advantages, namely, durability and low cost.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 2:
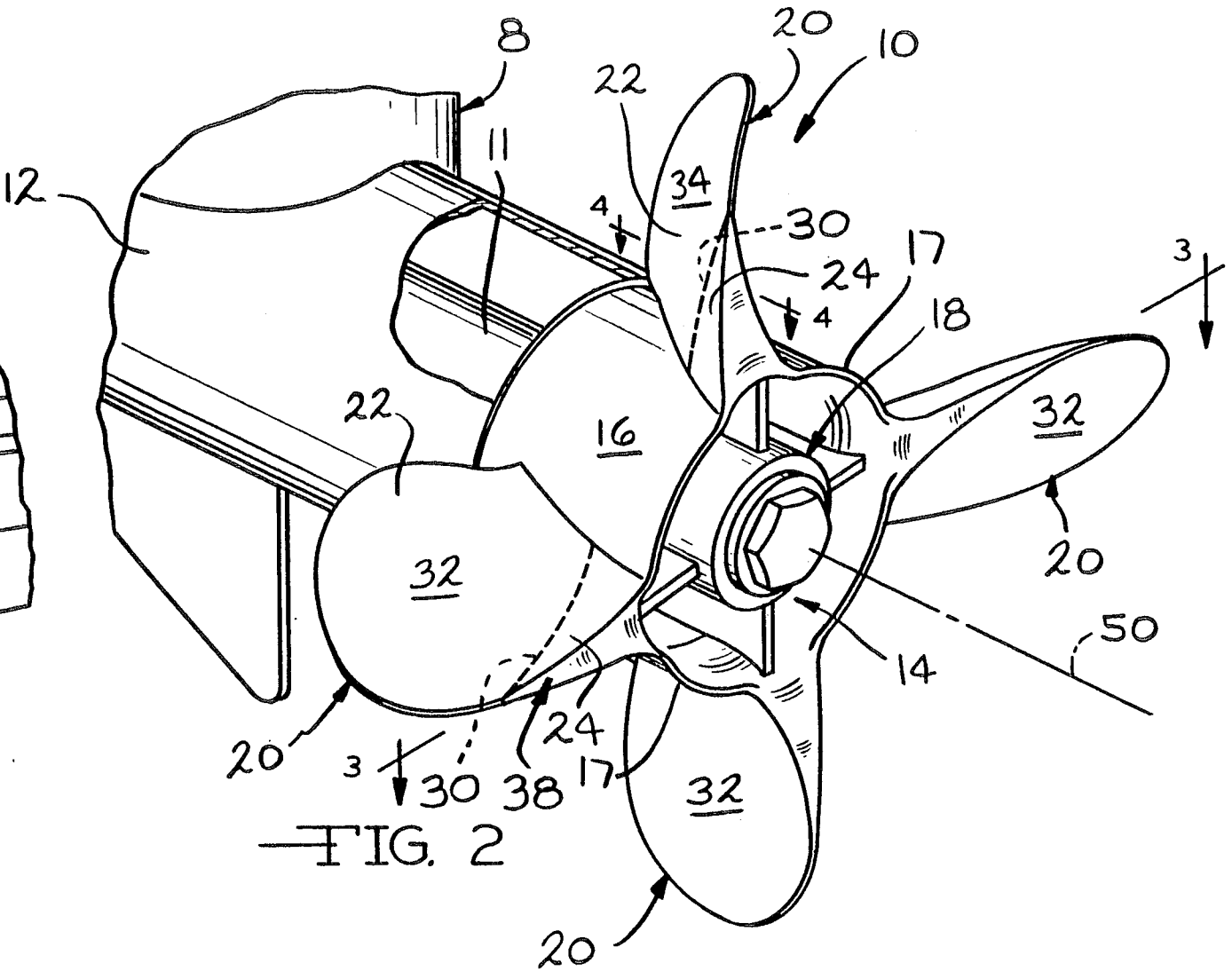
FIG. 2 is an enlarged fragmentary perspective view of the propeller assembly shown in FIG. 1.
Figure 1:
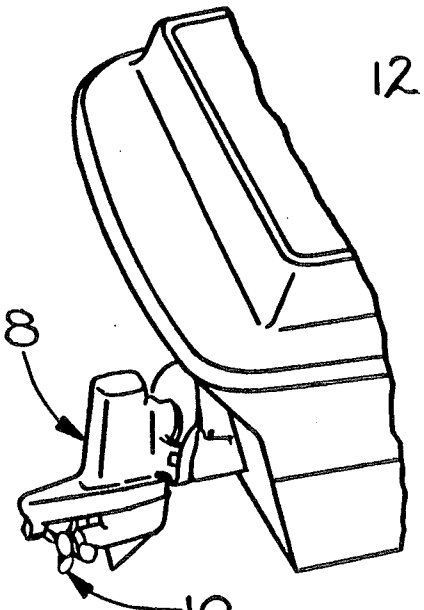
FIG. 1 is a fragmentary perspective view of the propeller of the present invention shown in assembly relation with the motor of a stern-drive boat.

With reference to the drawing, a propeller assembly constructed according to the principles of the present invention is shown in FIG. 1 and indicated generally at 10. In FIG. 2, the propeller 10 is attached to a drive shaft 11 enclosed within a housing member 12 forming part of the lower unit 8 of the boat's drive system.

The propeller 10 of the present invention exhibits some of the basic characteristics of a propeller of the standard "flow through" exhaust variety. Namely, the propeller 10 permits the flow and exit of exhaust gas, or possibly atmospheric air, through an annular passage 14 concentrically located within a circular hub 16 of the propeller 10. A rearward rim 17 of the hub 16 is flared to prevent the exhaust gas from backing up onto the exterior surface of the hub 16.

Centrally positioned within the annular passage 14 is a means for fastening 18 (not shown in FIG. 3) the propeller 10 to the drive shaft 11 of the motor. Attachment may be accomplished through use of a spline engagement, torque sensitive key or other method conventionally known within the industry.

Equidistantly positioned around the hub 16 are a number of integrally formed propeller blades 20. Each blade 20 consists of a forward fin portion 22 merging into a rearward base portion 24. In FIG. 2, the transition from the fin portion 22 to the base portion 24 is generally represented by a phantom transition line 30. The actual position of the transition line 30 will depend upon the particular design considerations.

Figure 4:
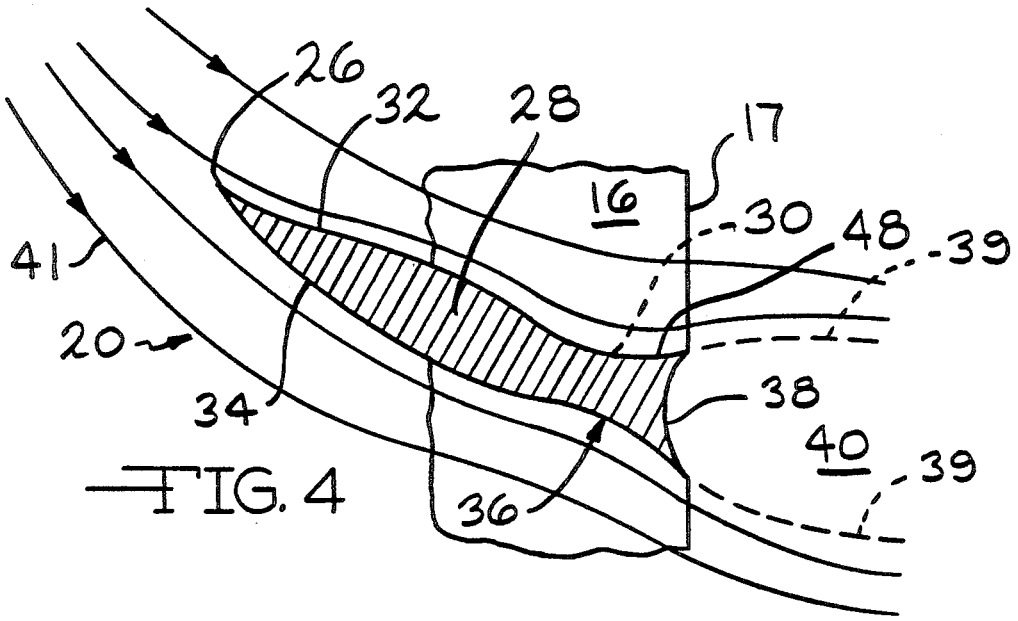

As is typical of propellers, the blades 20 of the present invention are both axially and radially arcuate about the central axis 50 of the hub 16. However, the blades 20 of the base vented propeller 10 differ from those of a conventional propeller in that the present blades 20 have a generally "fish-shaped" cross-sectional shape, as best seen in FIG. 4. The aforementioned patent application details the function and purpose of the "fish-shaped" cross-sectional shape.

Each blade 20 increases in thickness from a leading edge 26 to a local maximum thickness at a point near the midchord 28 of the blade 20. The precise location of this local maximum thickness would be governed by the design requisites of the particular propeller assembly. Thereafter, the blades 20 decrease in thickness until reaching a local minimum thickness at the transition line 30. The cross-sectional shape of the blades 20 then increase in thickness, along the concave surfaces of the pressure surface 32 and suction surface 34, in a "fish-tail" flare region 36 until terminating at a concave trailing edge 38. While the trailing edge 38 is shown as being concave in the present embodiment, it is possible that, depending on the design criteria, the concavity may be omitted without affecting the overall operation and performance of the invention.

Figure 3:
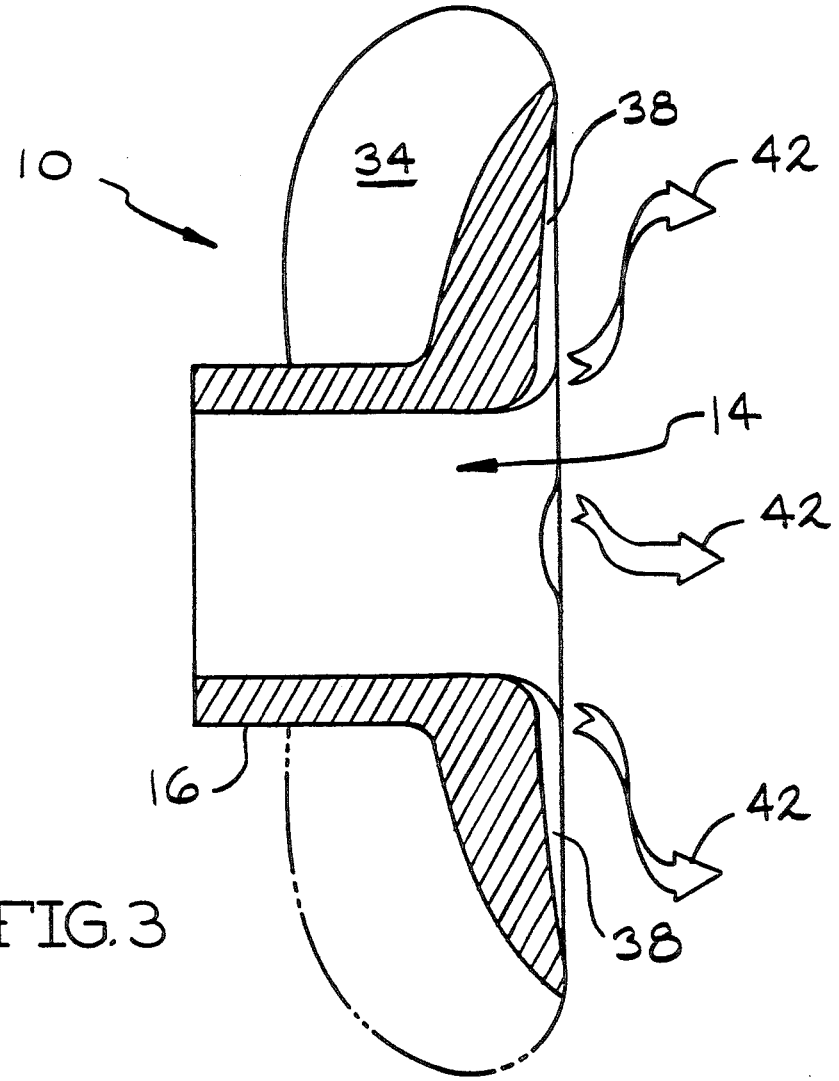
FIGS. 3 and 4 are sectional views taken substantially along lines 3—3 and 4—4, respectively, in FIG. 2 of the present invention.

As readily seen in FIGS. 2 and 3, the concave trailing edge 38 is smoothly transitioned from the flared rearward rim 17 and the interior surfaces of the hub 16 defining the annular passage 14. This construction permits exhaust gas to be readily and efficiently drawn from the annular passage 16 along the concave trailing edge 38 as further described below.

The increased thickness of both the midchord region 28 and the "fish-tail" flare region 36 provide the additional strength mentioned previously. Flaring the "fish-tail" region 36, induced by the concavity of the pressure surface 32 and the suction surface 34, allows the development of high pressure fence lines (not shown) along these surfaces 32 and 34 adjacent to the trailing edge 38. As explained below, the "fish-tail" flares 36 enable the blades 20 to maintain efficient low drag, subcavitating characteristics during high performance applications. This is accomplished through the exploitation of the exhaust gas exiting the annular passage 14 of the hub 16 at approximately atmospheric pressure.

As the velocity of the fluid flowing over the propeller blades 20 increases, a low pressure region 40 develops behind the trailing edge 38 of each blade 20. In this regard, the exhaust gas is at a "high" pressure relative to the developing low pressure region 40. Upon exiting the hub 16, the "high" pressure exhaust gas is drawn by the low pressure region 40 up along the concave trailing edge 38 of each post 24 and vents the low pressure region 40, as shown by the vent arrows 42 in FIG. 3.

The width and depth of each concave trailing edge 38 decreases as the distance away from the central axis 50 of the assembly increases. In this manner an adequate amount of exhaust gas is ensured to be provided to permit full ventilation development of the low pressure region 40. Failure to fully vent the low pressure region 40 would result in the occurrence of cavitation in this region 40 and, subsequently, an increase in drag. Dividing streamlines 39 display the boundary between the vent cavity of low pressure region 40, while fluid flow around the blade 20 is shown by streamlines 41.

While the increased fluid flow velocity develops the low pressure region 40 behind the trailing edge 38, this fluid velocity increase also promotes the development of a low pressure region in the forechord of the suction surface 34 of each blade 20. If left unchecked and the surface pressures become less than the water vapor pressure, cavitation or ventilation will occur and the drag of the propeller blades 20 will increase.

Prevention of cavitation is achieved in two ways. First, the increased thickness of the "fish-tail" flare 36 decreases the fluid flow velocity, thus delaying cavitation and not allowing blade drag to increase. Additionally, the high pressure fences prevent the introduction of exhaust gas to the developing low pressure region on the suction surface 34. In this manner, back ventilation is also prevented.

While FIGS. 3 and 4 show the present invention constructed of metal, it should be noted that a second embodiment of the invention enables the propeller assembly 10 to be constructed of a plastic resin. The nature of the invention is such that, depending upon the consumer's performance requirements, either the plastic or metal embodiment of the propeller 10 would be appropriate.

If a high performance propeller 10 is desired, one having an extended subcavitating operating range, a stainless steel embodiment would be appropriate. When compared to a conventional propeller having the same blade midchord thickness and section length, the present invention delays the appearance of cavitation. As previously mentioned, the "fish-shaped" cross-sectional shape, and in particular the increased thickness of the "fish-tail" flare, reduces fluid velocity over the blades 20. Thus during high performance operation, the pressure surface 32 and the suction surface 34 both operate fully wetted. If the propeller 10 is loaded beyond its design limit, the high pressure fence of the suction side trailing edge 38 will ultimately break down. Ventilation gas would then flood the low pressure area on the suction surface 34. However, the propeller 10 will maintain high efficiency (low drag) by operating under back ventilation conditions. This occurs without any significant loss in lift or thrust because, under these conditions, the lift development shifts from the designed meanline camber to the camber of the pressure face 32. The trailing edge pressure face flare 48 then participates effectively in the efficient development of lift during the back ventilated operation of the blades 20.

If economical midrange performance is the consumer's selection criteria, the plastic embodiment of the propeller 10 would be applicable. As previously mentioned, plastic propellers for high horsepower motors have been unsuccessful in the past because of an incompatibility between the strength requirements of plastic blades and the hydrodynamic considerations necessary for efficient functioning of the propeller. The "fish-shaped" cross-sectional shape alleviates these incompatibilities.

The blades 20 of a base vented plastic propeller 10 receive increased strengthening, in addition to that supplied by the "fish-tail" flare 36, through a further increase in midchord thickness. The size of increase varies with regard to the particular design requisites. With an increase in midchord thickness, the pressure drag associated with the blades 20 also increases. However, this pressure drag increase is minor relative to the drag increase that would occur if the propeller was allowed to cavitate and not vented. In all other respects, the plastic embodiment is analogous to the steel embodiment.

With its associated increase in pressure drag, the plastic embodiment operates at a "midrange" performance level when compared to the steel embodiment. However, this relative "midrange" performance is comparable to the performance specifications of aluminum replacement propellers presently on the market. With performance specifications being comparable, the base vented plastic propeller offers additional benefits in that durability is increased while cost is decreased.

While the above description constitutes the preferred embodiments of the present invention, it will be appreciated that the invention is susceptible to modification, variation and change without departing from the proper scope and fair meaning of the accompanying claims.

I claim:

1. A propeller assembly having means for mounting to the drive shaft of a propeller driven water vehicle, the assembly comprising:

a hollow hub defining a central axis and having an annular cross-sectional shape through which a gas can flow; and a plurality of generally radially extending arcuate blades positioned substantially equidistantly on said hub, said blades having a generally fish-shaped cross-sectional shape, said cross-sectional shape increasing in thickness in a forwardly located fin portion from a leading edge to a local maximum thickness and subsequently decreasing in thickness to a local minimum thickness, said cross-sectional shape thereafter increasing in thickness along concave surfaces of a rearwardly located post portion being integrally formed with said fin portion and said hub, said post portions being flared and rearwardly terminating said blade at a trailing surface, said trailing surface forming a smooth transition from the interior of said hollow hub for drawing the gas flowing through said hub therealong, whereby said fish-shaped cross-sectional shape and ventilating of said trailing surface enables said propeller assembly to function efficiently at increased operational speeds by effectuating a delay in the appearance of cavitation, wherein said hub includes a flared rear rim formed thereon, said trailing surface being smoothly formed with said flared rear rim.

2. A propeller assembly as set forth in claim 1 wherein said trailing surface is concave.

3. A propeller assembly as set forth in claim 2 wherein said trailing surface defines a generally triangular cup shaped volume.

4. A propeller assembly as set forth in claim 1 wherein said assembly is constructed of metal.

5. A propeller assembly as set forth in claim 4 wherein said metal is stainless steel.

6. A propeller assembly as set forth in claim 1 wherein said assembly is constructed of plastic resin.

* * * * *